US007407232B2

(12) United States Patent
Sakamoto et al.

(10) Patent No.: US 7,407,232 B2
(45) Date of Patent: Aug. 5, 2008

(54) SEAT FOR A CHILD

(75) Inventors: Yukio Sakamoto, Saitama (JP); Akira Okahashi, Saitama (JP)

(73) Assignee: Combi Corporation, Tokyo (JP)

( * ) Notice: Subject to any disclaimer, the term of this patent is extended or adjusted under 35 U.S.C. 154(b) by 490 days.

(21) Appl. No.: 11/086,334

(22) Filed: Mar. 23, 2005

(65) Prior Publication Data

US 2005/0218705 A1 Oct. 6, 2005

(30) Foreign Application Priority Data

Mar. 30, 2004 (JP) ..... 2004-098833

(51) Int. Cl.
*A47C 7/54* (2006.01)

(52) U.S. Cl. ..... 297/411.2; 297/411.32; 297/411.37; 297/411.38; 297/188.01; 297/188.14

(58) Field of Classification Search ..... 297/411.2, 297/411.32, 411.34, 411.37, 411.38, 188.01, 297/188.14, 188.19
See application file for complete search history.

(56) References Cited

U.S. PATENT DOCUMENTS 1,490,538 A * 4/1924 Owen ..... 224/275
1,702,955 A * 2/1929 Zaday ..... 297/111
1,869,444 A * 8/1932 Tobey ..... 297/145
2,494,838 A * 1/1950 Slaughter ..... 297/145
3,632,161 A * 1/1972 Arfaras et al. ..... 297/145
4,191,420 A * 3/1980 Fassett et al. ..... 312/235.6
4,411,471 A * 10/1983 Ponzellini ..... 297/411.34
5,474,355 A 12/1995 Lerner et al.
5,709,155 A 1/1998 Terracciano
6,419,314 B1 * 7/2002 Scheerhorn ..... 297/188.19

FOREIGN PATENT DOCUMENTS

JP 2003-24189 A 1/2003
JP 2003-88451 A 3/2003

* cited by examiner

*Primary Examiner*—Laurie K Cranmer
(74) *Attorney, Agent, or Firm*—Birch, Stewart, Kolasch & Birch, LLP

(57) ABSTRACT

A seat for a child 1 includes a seat portion 10 on which a child can sit, and a pair of armrests 30 disposed on right and left sides of the seat portion 10, each armrest 30 having a relatively larger thickness. Each of the armrest 30 has a body member 32 and an upper half member 33. The upper half member 33 is attached to the body member 32 through hinge mechanisms 35 and 36, such that the upper half member 33 can be pivoted outward. The pivotable upper half member 31 can be moved outward relative to the hinge mechanisms 35 and 36. An upper surface 31*a* of the pivoted upper half member 31 of the armrest 30 and an upper surface 32*a* of the body member 32 of the armrest 30 are flush with each other.

9 Claims, 9 Drawing Sheets

SEAT FOR A CHILD

BACKGROUND OF THE INVENTION

1. Field of the Invention

The present invention relates to a seat for a child to be used as a chair or a bed for a baby or a child.

2. Background Art

A seat for a child including a reclining mechanism has been conventionally proposed and used. Such a seat for a child, on which a child can sit or lie, can be moved in a room by means of wheels attached to its legs. A height of the seat for a child can be adjusted when, for example, a child is eating. That is, the seat for a child includes a pair of right and left X-shaped legs, each having a front leg member and a rear leg member. The front leg member and the rear leg member are pivotally coupled to each other at their intermediate parts to form an X-shape. By swinging the front leg member and the rear leg member closer to or further away from each other, a height of the seat can be adjusted. In order to facilitate a turning of the seat when it is moved in a room, turnable wheels are attached to lower ends of, in particular, front leg members of the X-shaped legs, so that the direction of the seat for a child can be freely changed.

The conventional seat for a child is provided with armrests disposed on right and left sides of the seat. In order to effectively use a space around the seat for a child, each of the armrests has a horizontally pivotable side plate for an article. Thus, one can put articles such as diapers or baby powder containers on the pivoted side plate, when he/she changes diapers of a child on the seat. Such a conventional seat for a child is disclosed in, for example, Japanese Patent Laid-Open Publication Nos. 2003-24189 and 2003-88451.

However, in an armrest having a larger thickness, an upper surface of a body member of the armrest and an upper surface of the horizontally pivoted side plate might not be flush with each other, due to the use of a conventional hinge mechanism. Such a stepped surface is ill-suited to put an article thereon. In addition, a side surface of the body member and a lower surface of the side plate to be pivoted must be parallel with each other, in order not to from a gap between the upper surface of the body member and the upper surface of the pivoted side plate. However, from a design viewpoint, a seat for a child recently has an armrest whose width is decreased toward a front thereof. A general hinge mechanism cannot be used in such a tapered armrest.

SUMMARY OF THE INVENTION

The present invention is made in view of the above problems. An object of the present invention is to provide a seat for a child including an armrest having a body member and an upper half member which can be pivoted into a horizontal posture. When the upper half member is pivoted to the horizontal posture, an upper surface of the body member and an upper surface of the horizontally pivoted upper half member are flush with each other. Further, even when a side surface of the body member and a lower surface of the upper half member to be pivoted are not parallel with each other, the upper half member can be easily pivoted into the horizontal posture, without a gap being formed between the surfaces of the body member and the upper half member.

The present invention is a seat for a child comprising: a seat portion on which a child can sit; a back portion disposed on a rear part of the seat portion; and a pair of armrests disposed on right and left sides of the seat portion, wherein at least one of the armrests includes a body member, and an upper half member attached to the body member of the armrest through a hinge mechanism, the upper half member capable of being pivoted outside the body member, the upper half member of the armrest can be held at a perpendicular posture on the body member, and can move on the body member, and when the upper half member is slid on the body member and is pivoted outside the body member, an upper surface of the upper half member pivoted into a horizontal posture is flush with an upper surface of the body member.

In the seat for a child, the hinge mechanism may include a shaft disposed in the body member of the armrest to extend in the back and forth direction, and a link attached to the shaft to project outward from the body member of the armrest, the link being capable of rotating between a perpendicular position and a horizontal position, and an end of the link may be engaged with an elongated hole formed in a bottom surface of the upper half member, so that the upper half member of the armrest can be moved outside relative to the link.

In the seat for a child, the shaft of the body member may be positioned inside the body member at an upper part on one side, and the link may rotate between the perpendicular position and the horizontal position, with the end thereof constantly projecting outward from the body member.

In the seat for a child, the elongated hole formed in the bottom surface of the upper half member of the armrest may extend in a right and left direction over substantially an entire width of the bottom surface.

In the seat for a child, the shaft may be held, at a front part and a rear part thereof, by the body member of the armrest through brackets, each having a fitting hole with which the shaft is engaged, and the fitting hole of one of the brackets supporting the front part or the rear part of the shaft may be an elongated hole extending in the right and left direction, so that an orientation of the shaft can be varied within a predetermined angle in the right and left direction.

In the seat for a child, the hinge mechanism may include at least two links disposed on the front part and the rear part of the shaft.

In the seat for a child, at least one of the upper surface of the body member of the armrest and the upper surface of the upper half member of the armrest pivoted into the horizontal posture may be provided with a recess for an article.

In the seat for a child, a leg portion may be disposed on the front part of the seat portion, and the leg portion may be provided with, at right and left sides thereof, sidewalls each having a relatively larger thickness.

In the seat for a child, the back portion may have a reclining mechanism.

In the seat for a child, one of the upper half member and the body member may be provided with a locking member which can be projected and retracted, and the other member may be provided with an engagement hole with which the locking mechanism can be engaged, so as to maintain the upper half member of the armrest at the perpendicular posture on the body member.

According to the present invention, the upper half member of the armrest disposed on a side of the seat portion is capable of being pivoted outside the body member by means of the hinge mechanism. The upper half member of the armrest can be moved outward relative to the hinge mechanism. The upper surface of the upper half member pivoted into the horizontal posture is configured to be flush with the upper surface of the body member. Since the upper surface of the body member and the upper surface of the pivoted upper half member are flush with each other, one can put an article thereon, whereby a space around the seat for a child can be effectively used. Since the fitting hole supporting the front part or the rear part of the shaft constituting the hinge mechanism is an elongated hole extending in the right and left direction, an orientation of the shaft can be varied within a predetermined angle in the right and left direction. Thus, even when the side surface of the body member and the lower surface of the upper half part to be pivoted are not parallel with each other, the upper half member can be easily pivoted into the horizontal posture, without a gap being formed between the surfaces of the body member and the upper half member.

DETAILED DESCRIPTION OF THE INVENTION

An embodiment of the present invention will be described below with reference to the accompanied drawings.

Figure 1:
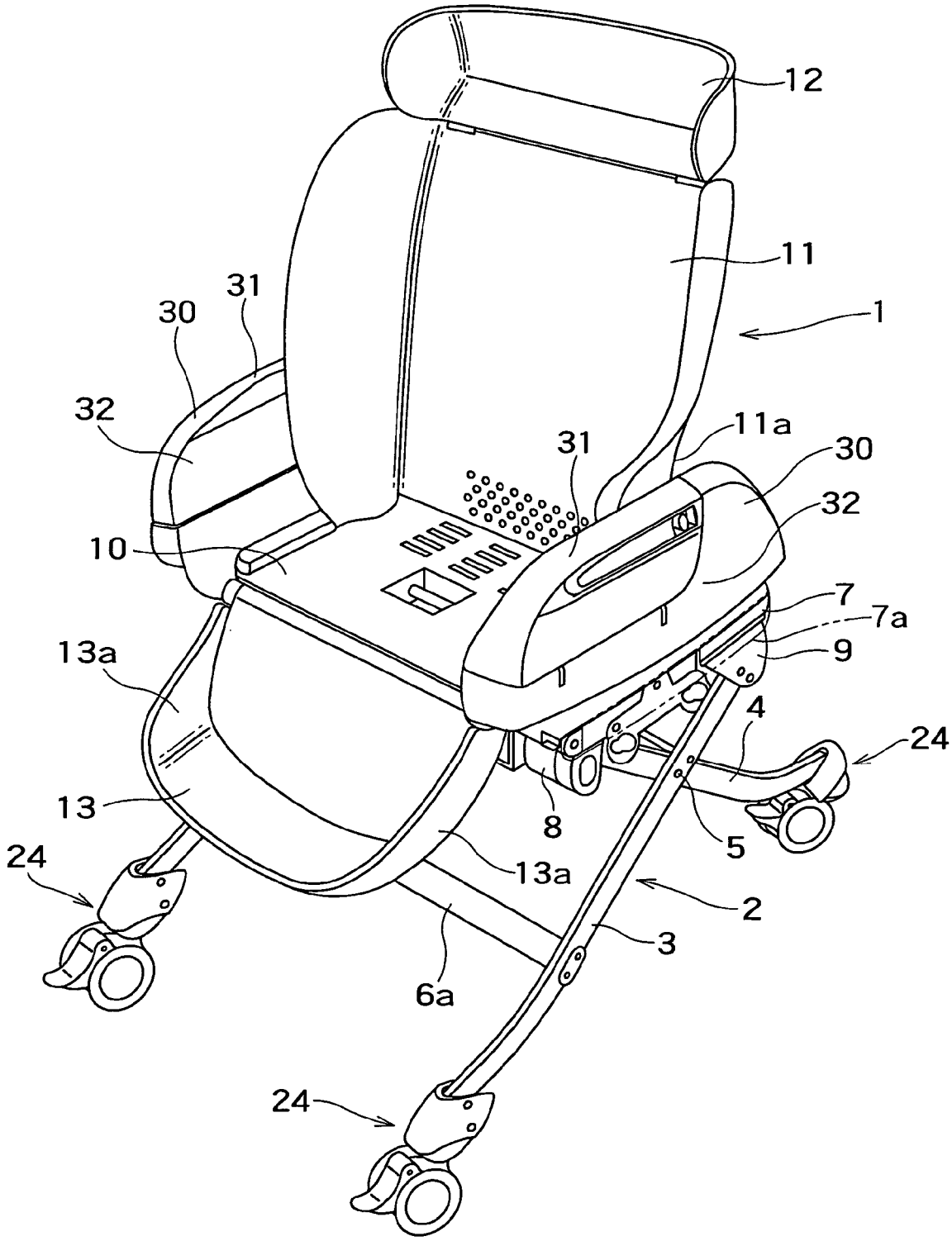
FIG. 1 is a perspective view of a seat for a child according to the present invention.
Figure 2:
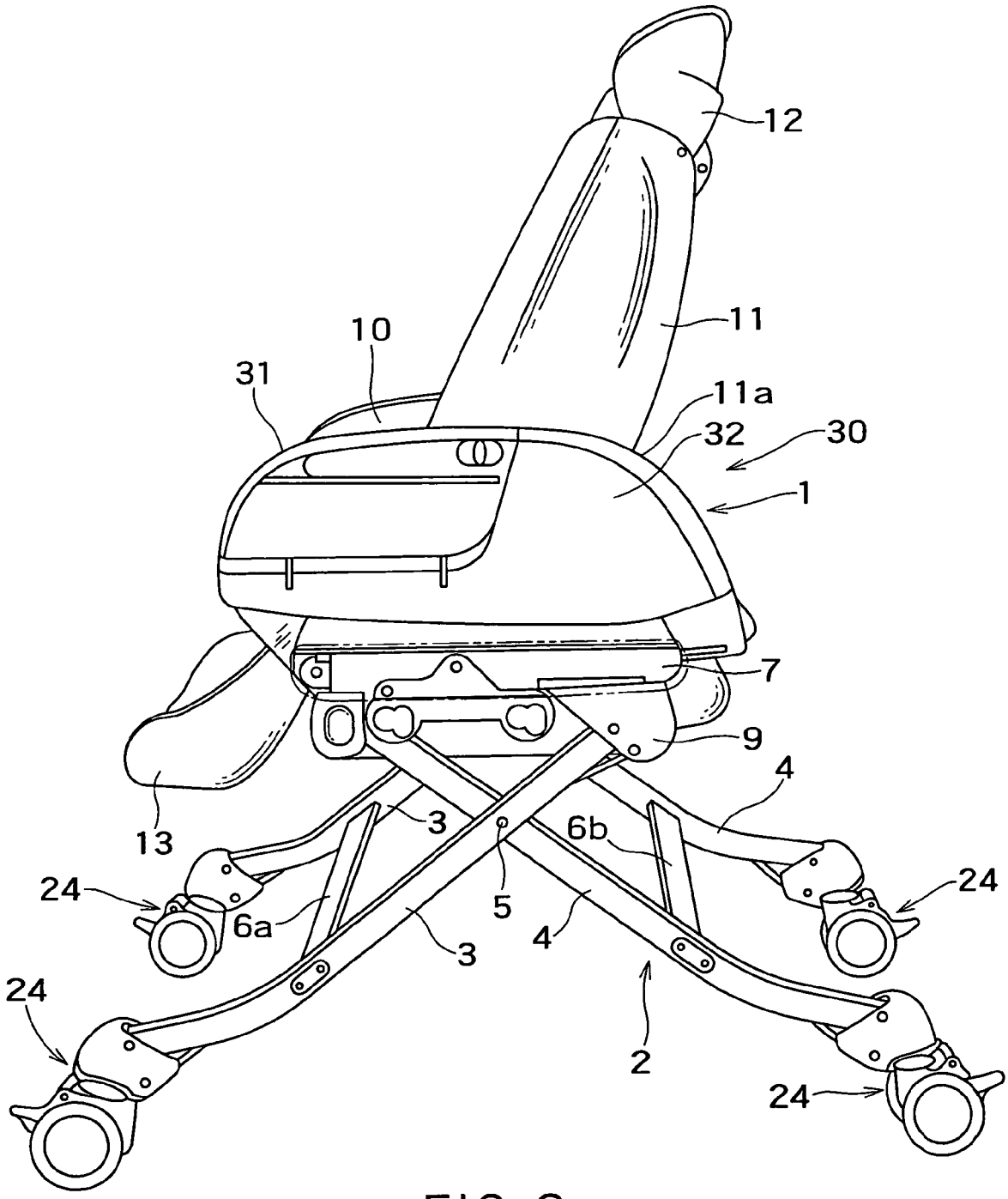
FIG. 2 is a side view of the seat for a child according to the present invention.

FIG. 1 is a perspective view schematically showing a seat for a child, and FIG. 2 is a side view thereof. A seat for a child 1 is supported by a pair of right and left X-shaped legs 2. Each of the X-shaped legs 2 includes a front leg member 3 and a rear leg member 4 which are pivotally coupled to each other at their intermediate parts by a pin 5. As shown in FIG. 2, the right and left front leg members 3 are connected to each other by a front connection rod 6*a*, while the rear leg members 4 are connected to each other by a rear connection rod 6*b*. An upper end of each of the rear leg members 4 is pivotally attached to a boss 8 disposed on a front part of a seat support member 7. An upper end of each of the front leg members 3 is pivotally attached to a hinge connection 9 which is movably attached to a rear part of the seat support member 7 in a back and forth direction thereof. As shown by a two-dot chain line in FIG. 1, the seat support member 7 is provided with, at an outside surface thereof, a cover 7*a* for covering the seat support member 7, the boss 8, and the hinge connection 9 from above. The seat for a child 1 is mounted on the seat support member 7 in a manner where the seat can be swung in a back and forth direction.

The X-shaped legs 2 and the seat for a child 1 constitute a child seat apparatus.

Figure 3:
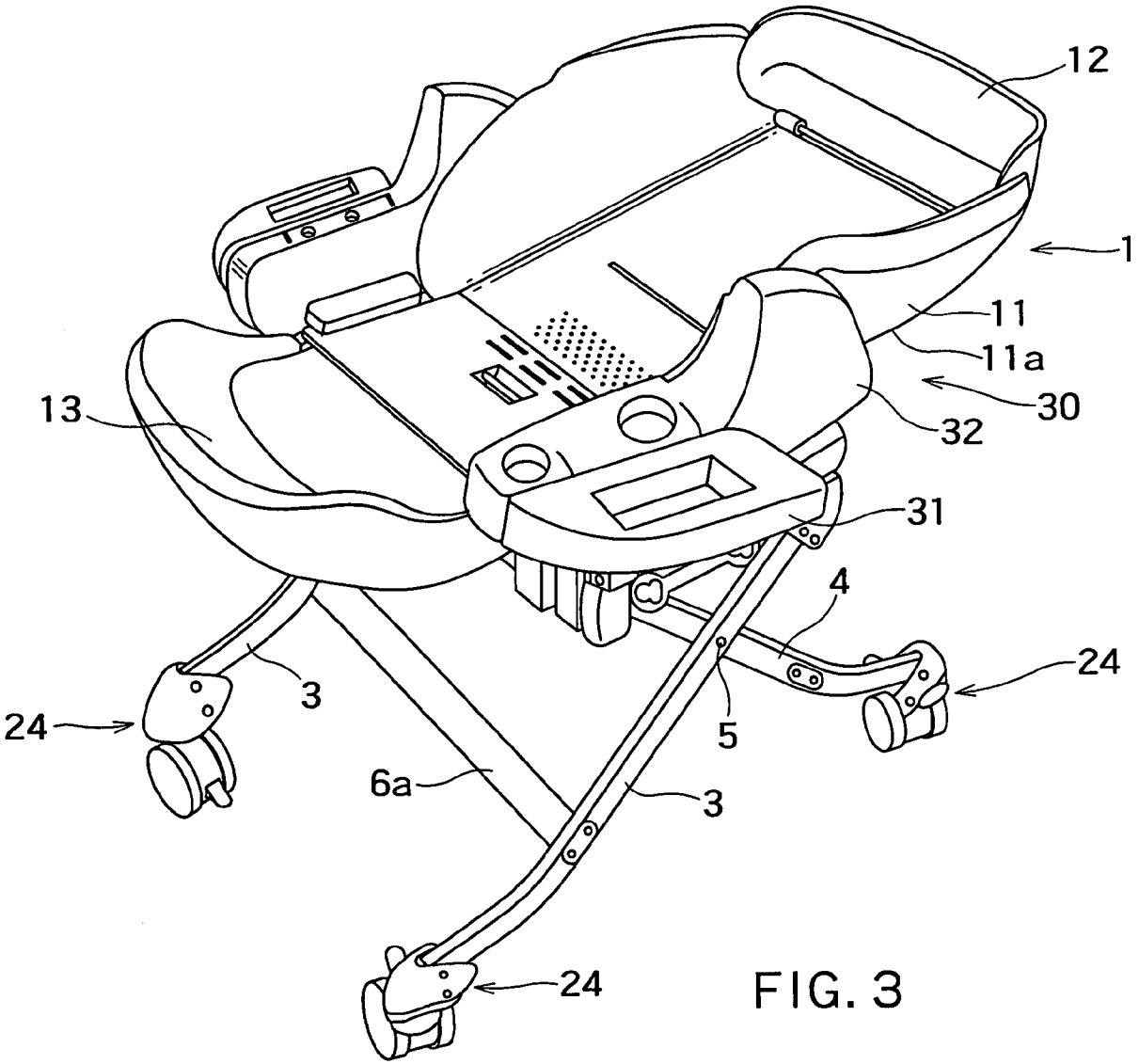
FIG. 3 is a perspective view of the seat for a child when used as a bed.

As shown in FIGS. 1 and 2, the seat for a child 1 includes a seat portion 10 on which a child can sit, a back portion 11 disposed on a rear part of the seat portion 10, a headrest 12 disposed on an upper part of the back portion 11, and a leg portion 13 disposed on a front part of the seat portion 10. The back portion 11 has a reclining mechanism 11*a*. Thus, as shown in FIG. 1, the back portion 11 can take an upright position, in order that the seat for a child 1 can be used as a chair. On the other hand, as shown in FIG. 3, the back portion 11 can take a reclined position, in order that the seat for a child 1 can be used as a bed. When the back portion 11 is reclined in order to use the seat for a child 1 as a bed, the leg portion 13 swings upward in conjunction with a rearward swinging movement of the back portion 11, so that legs of a child on the seat for a child 1 can be supported by the leg portion 13. The leg portion 13 is provided with, at right and left sides thereof, sidewalls 13*a* each having a relatively larger thickness. Thus, when the seat for a child 1 is used as a bed, a child on the seat for a child 1 can be prevented from tumbling off. In addition, such a thick sidewall 13*a* can eliminate an anxious feeling over the possibility of a child falling off the seat for a child 1.

Figure 4:
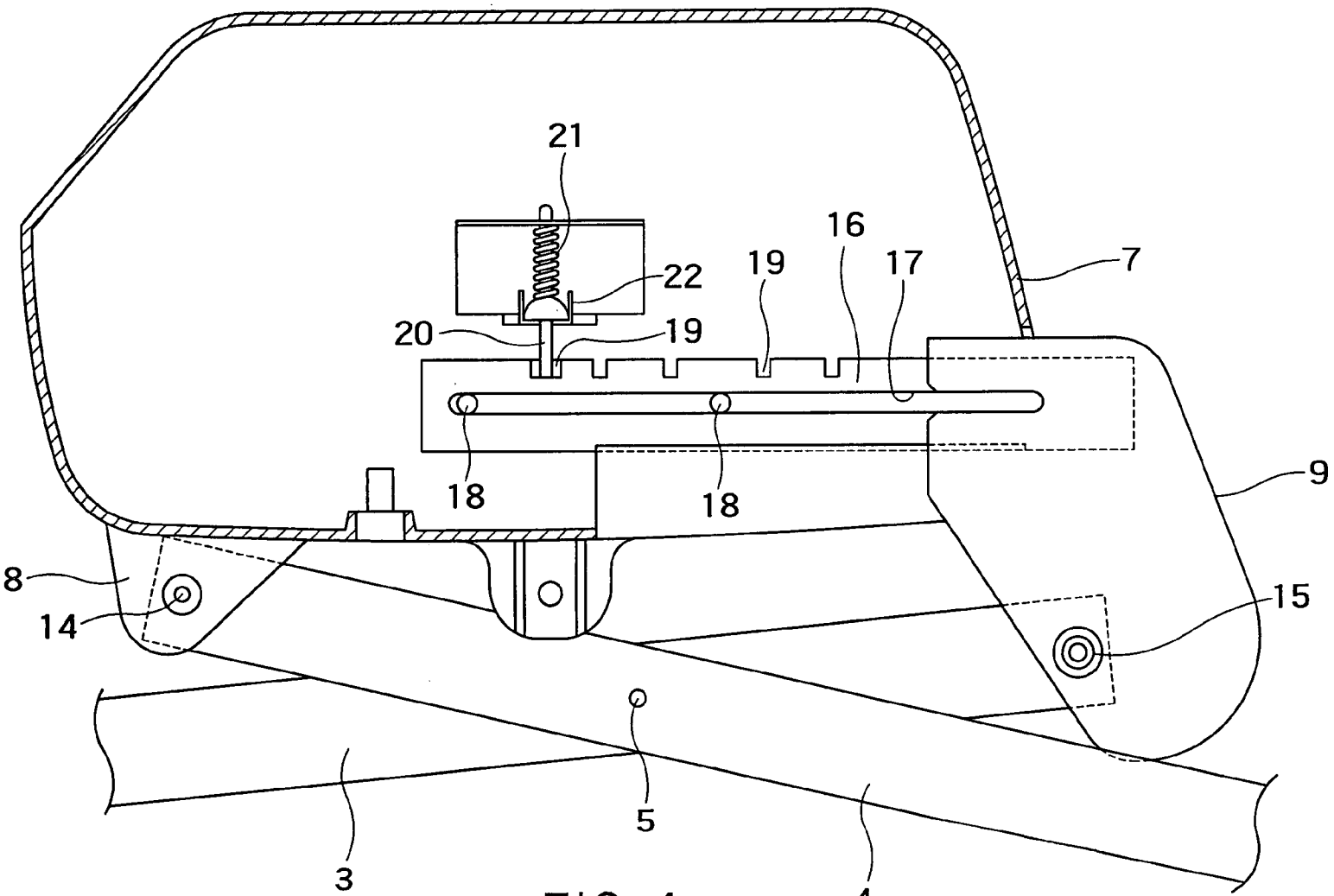
FIG. 4 is a view of a connecting constitution of a front leg member, a rear leg member, and a seat support member.

FIG. 4 is a view showing a connecting constitution of the front leg member 3, the rear leg member 4, and the seat support member 7. The upper end of the rear leg member 4 is pivotally attached to the boss 8 of the seat support member 7 through a pin 14. The upper end of the front leg member 3 is pivotally attached to the hinge connection 9 through a pin 15. The hinge connection 9 has a slide bar 16 which is slidably received in the seat support member 7 in the back and forth direction. The slide bar 16 is provided with an elongated opening 17 extending into the hinge connection 9 in the back and forth direction, i.e., a longitudinal direction of the slide bar 16. The seat support member 7 has two projecting pins 18 which are spaced from each other. The pins 18 are inserted to the elongated opening 17. By an engagement of the elongated opening 17 and the pins 18, the slide bar 16 can slide in the longitudinal direction thereof. The slide bar 16 is urged by a spring (not shown) in the left direction in FIG. 4, i.e., in a direction where the X-shaped leg 2 is elongated in a height direction of the seat for a child 1.

The slide bar 16 is rectangular in section. A plurality of aligned adjusting holes 19 are formed in an upper surface of the slide bar 16 in the longitudinal direction. The seat support member 7 has a pin 20 to be selectively inserted to one of the adjusting holes 19. The pin 20 is capable of being moved in the height direction, and is urged by a spring 21 in a direction where the pin 20 is inserted to the adjusting hole 19. The seat support member 7 has a lever 22 which is engaged with the pin 20 at a part of a larger diameter. The lever 22 projects outward from the seat support member 7, and is capable of being moved in the height direction along the pin 20.

When the lever 22 is drawn upward from the outside of the seat support member 7, the pin 20 moves upward against the urging force of the spring 21, so that the pin 20 is disengaged from one of the adjusting holes 19. After the pin 21 is disengaged from the adjusting hole 19, the slide bar 16 is moved in the left direction in FIG. 4 by means of a spring force of a spring (not shown). Therefore, the X-shaped leg 2, which is formed of the front leg member 3 and the rear leg member 4 hinged to each other, is elongated in the height direction, so that the seat portion 10 of the seat for a child 1 can be elevated.

Figure 5:
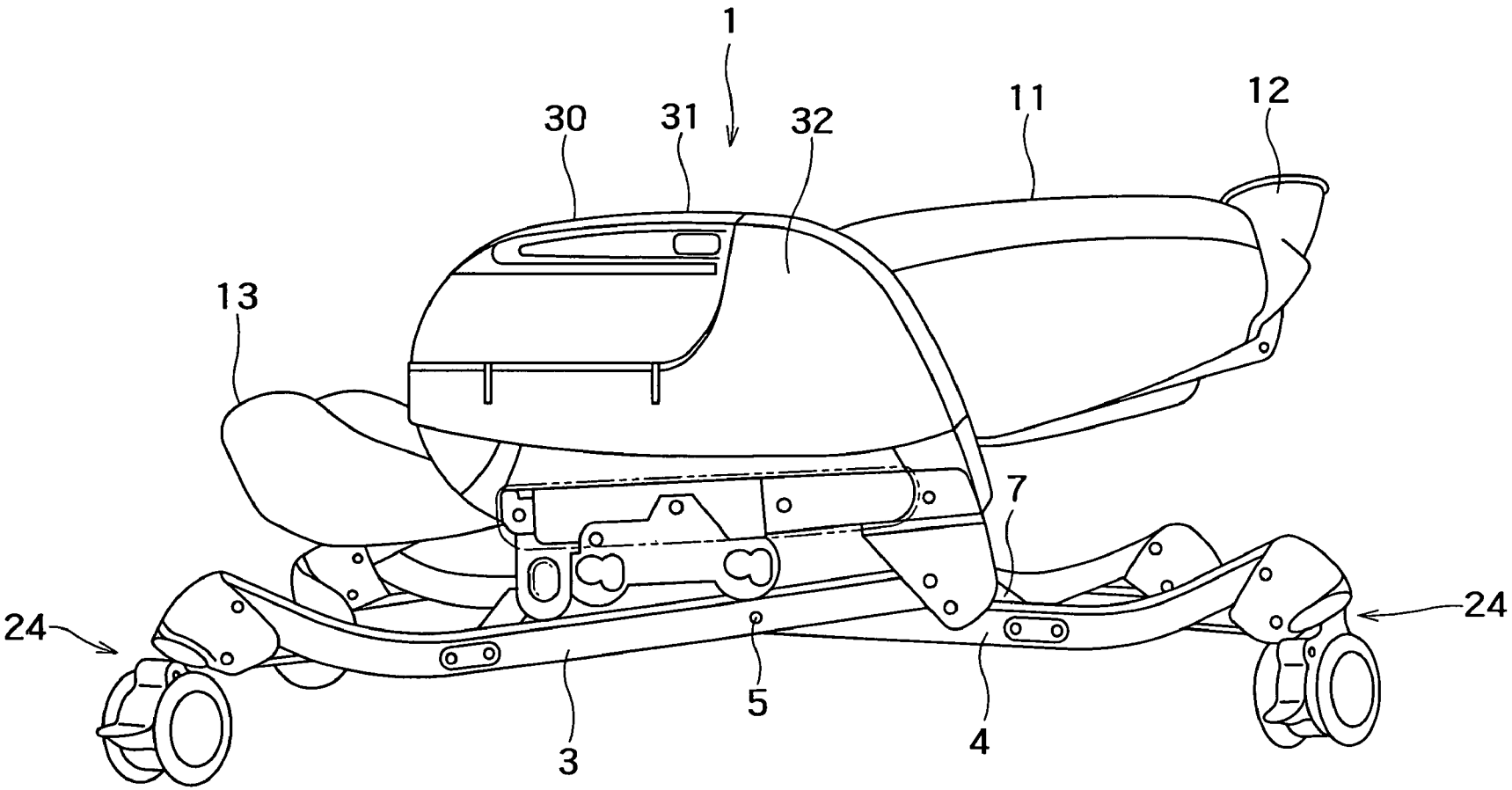
FIG. 5 is a side view of the seat for a child according to the present invention which is in the lowest collapsed position.

On the other hand, in this elevated state of the seat for a child 1, when the lever 22 is drawn upward to disengage the pin 20 from the adjusting hole 19 and the seat support member 7 is pushed downward, the slide bar 16 along with the hinge connection 9 is moved in the right direction in FIG. 2, so that inclination angles of the front leg member 3 and the rear leg member 4 become smaller. When the hinge connection 9 reaches a rightmost position, the pin 20 is engaged with the leftmost adjusting hole 19. At this time, the seat for a child 1 takes a collapsed position in which the height of the seat portion 10 of the seat for a child 1 is most lowered. The seat for a child 1 in the lowest position is shown in FIG. 5.

Wheels 24 are attached to lower ends of the respective front leg members 3 and the rear leg members 4. By means of the wheels 24, the seat for a child 1 can be easily moved in all directions, and can move in a small circle. Thus, the seat for a child 1 can be freely moved in a narrow room.

Figure 6:
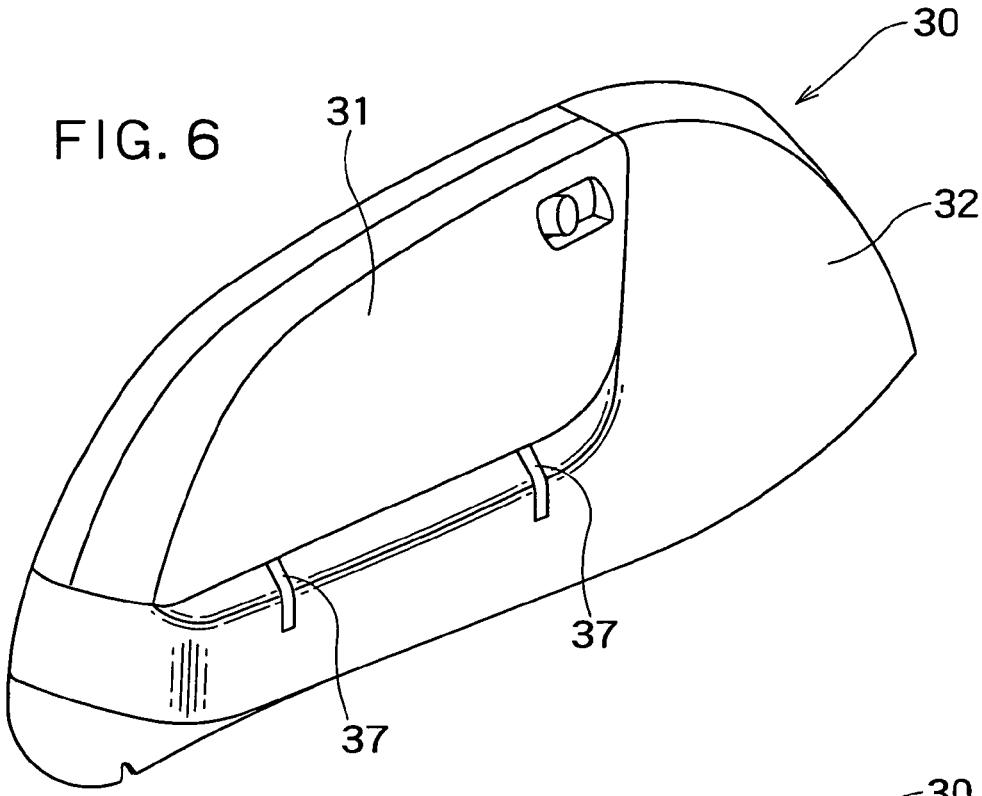
FIG. 6 is a perspective view of an exterior of an armrest.
Figure 7:
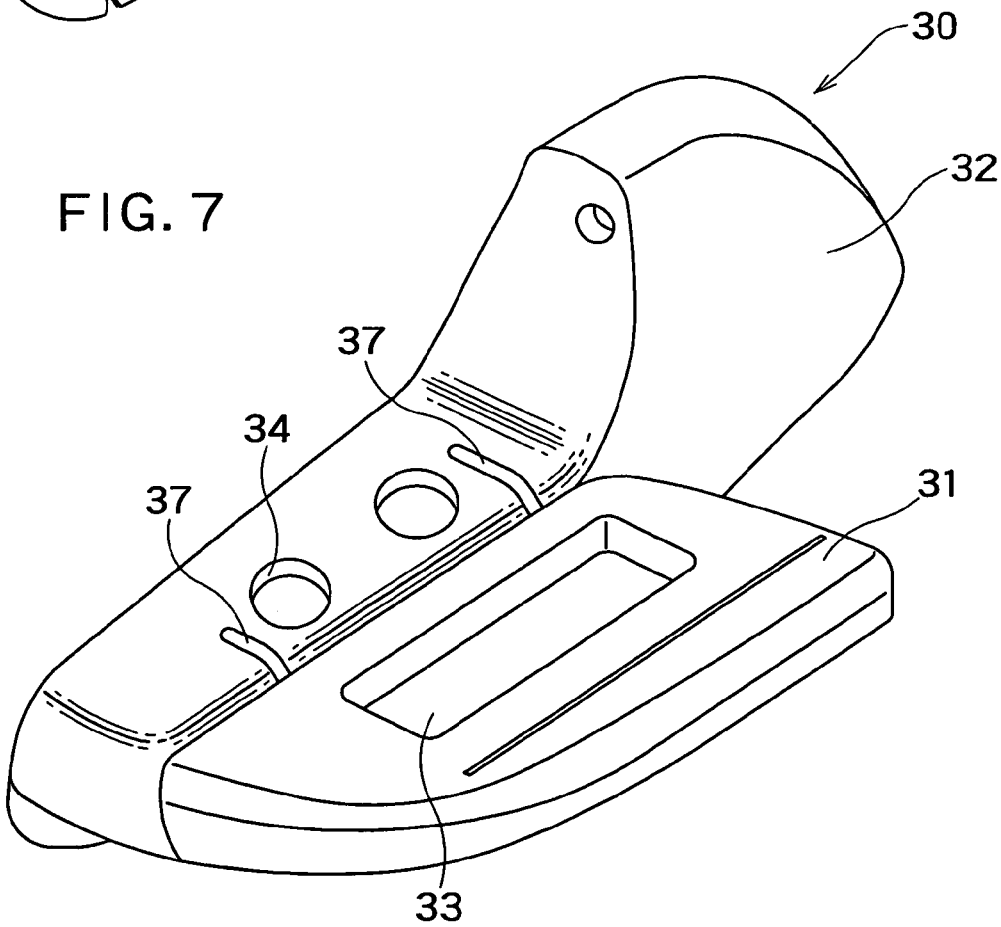
FIG. 7 is a perspective view of the armrest in which an upper half member thereof is pivoted into a horizontal posture.

A pair of armrests 30 each having a relatively larger thickness are disposed on right and left sides of the seat portion 10. As shown in FIG. 6, each of the armrests 30 has a body member 32 fixed on the seat portion 10, and an upper half member 31 separated from the body member 32. The body member 32 and the upper half member 31 form a horizontal plane therebetween. As shown in FIG. 6, the upper half member 31 can take a perpendicular posture, and can be pivoted outward from the perpendicular posture to a horizontal posture which is shown in FIG. 7. In this manner, the pivoted upper half part 31 can serve as a board for an article. An upper surface 32*a* of the body member 32 of the armrest 30 is provided with a recess 34 for a cup or the like. An upper surface 31*a* of the outward pivoted upper half member 31 of the armrest 30 is provided with a recess 33 for an article such as a diaper or a baby powder container, which can be used when one changes diapers of a child on the seat for a body 1. Such a recess may be formed in either the upper surface 32*a* of the body member 32 or the upper surface 31*a* of the upper half member 31.

Figure 8:
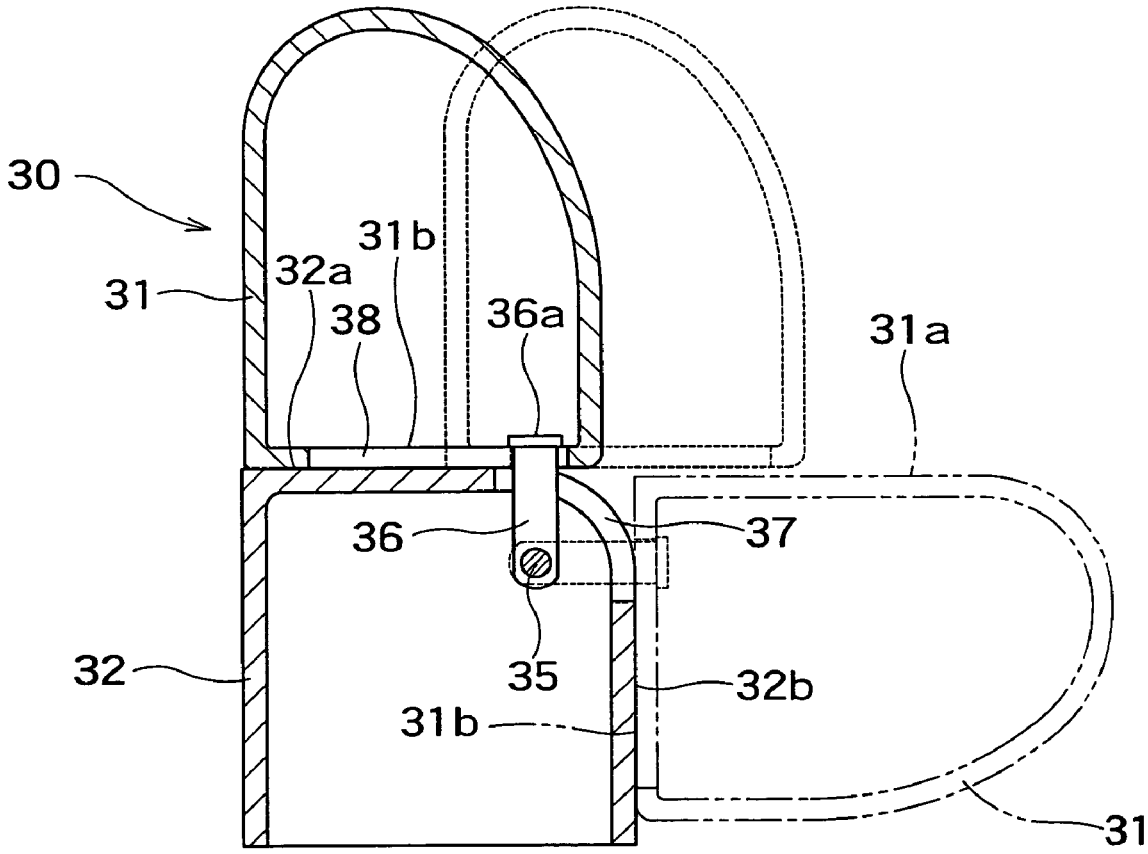
FIG. 8 is a view of a connection between the upper half member of the armrest and a body part of the armrest, and a pivoting operation of the upper half member of the armrest relative to the body part of the armrest.

As shown in FIG. 8, a shaft 35 extending in the back and forth direction is disposed in the body member 32 of the armrest 30. Two links 36, 36 each having an end 36*a* are attached to the front and rear parts of the shaft 35. The body member 32 of the armrest 30 is provided with two corner holes 37 at a corner thereof. Each of the corner holes 37 extends from the upper surface 32*a* of the body member 32 to a side surface thereof. Each of the links 36 passes through the corner hole 37, with its end 36*a* projecting outward from the corner hole 37. The projected link 36 from the corner hole 37 is rotated about the shaft 35 from a perpendicular position to a horizontal position, and vice versa. The upper half member 31 of the armrest 30 has an elongated hole 38 in the bottom surface 31*b* extending in the right and left direction when the upper half member 31 takes a perpendicular posture. The end 36*a* of the link 36 is engaged with the elongated hole 38. When the upper half part 31 of the armrest 30 moves on the body member 32, the links 36 move along the elongated hole 38 only in the right and left direction. In this case, the upper half member 31 slides on the body member 32 in the right and left direction.

The shaft 35 and the two links 36, 36 constitute the hinge mechanisms 35, 36, 36.

Figure 9:
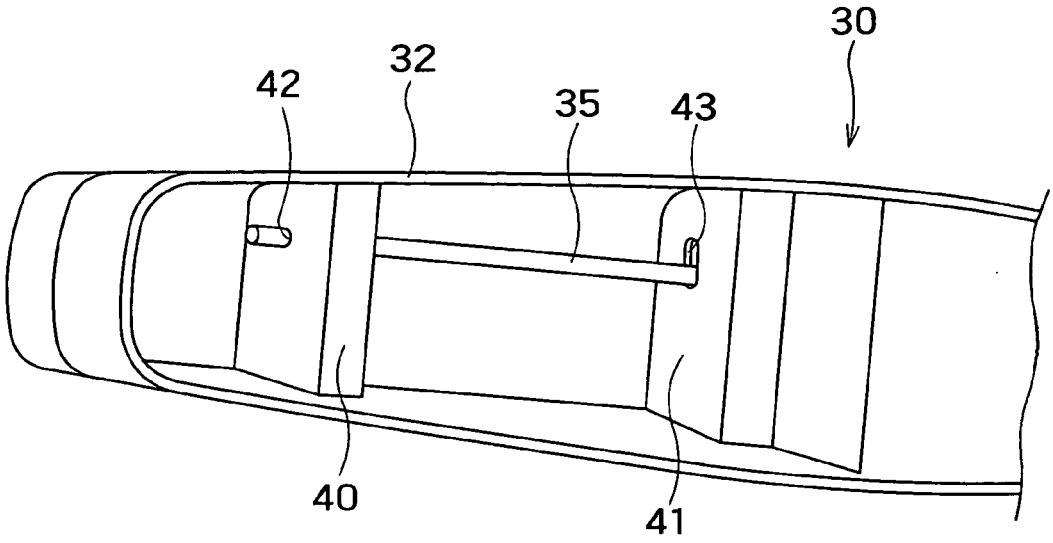
FIG. 9 is a bottom view of the armrest.
Figure 10:
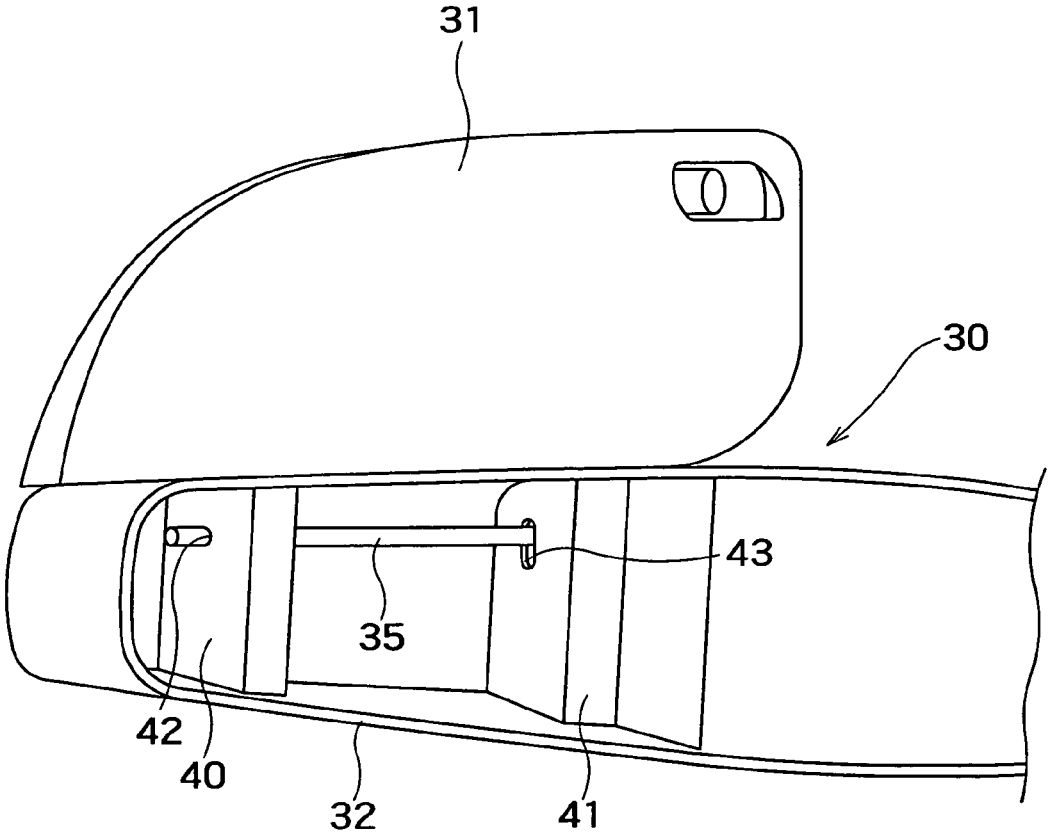
FIG. 10 is a view of the armrest shown in FIG. 9 in which the upper half member of the armrest is pivoted into the horizontal posture.

FIGS. 9 and 10 are bottom views of the armrest 30. Both ends of the shaft 35 are fitted in fitting holes 42 and 43 of respective brackets 40 and 41 disposed in the body member 32 of the armrest 30. In more detail, the bracket 40 disposed in a front part of the body member 32 has the circular fitting hole 42, while the bracket 41 disposed in a rear part of the body member 32 has the elongated fitting hole 43 extending in the right and left direction of the armrest 30. A front end of the shaft 35 is fitted in the circular fitting hole 42, and a rear end of the shaft 35 is fitted in the elongated fitting hole 43. The rear end of the shaft 35 can move along the elongated fitting hole 43 in the right and left direction, so that an orientation of the shaft 35 can be varied within a predetermined angle in a horizontal plane.

Figure 11:
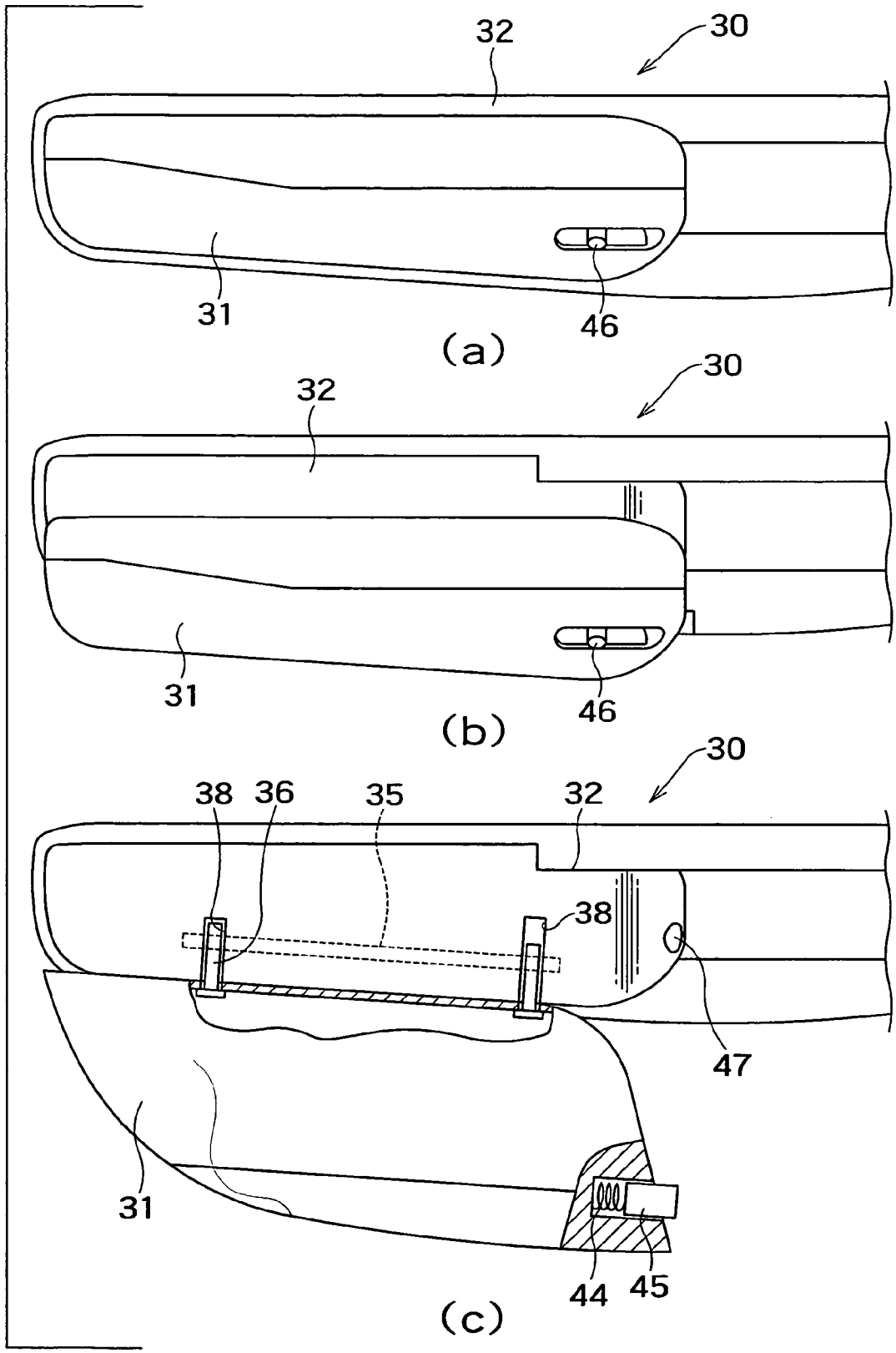
FIGS. 11(*a*) to 11(*c*) are views illustrating a pivoting operation of the upper half member of the armrest.

As shown in FIG. 11(*c*), a locking member 45 is disposed on a rear end of the upper half member 31 of the armrest 30. The locking member 45 is urged by a spring 44 so as to project rearward. An engagement hole 47 is formed in the body member 32 of the armrest 30. The locking member 45 can be engaged with the engagement hole 47 and disengaged therefrom, by operating an operation button 46 disposed on a side part of the upper half member 31 of the armrest 30. When the locking member 45 is engaged with the engagement hole 47, the upper half member 31 of the armrest 30 can be maintained at the perpendicular posture (see FIG. 6). When the locking member 45 is retracted against a spring force of the spring 44 through the operation button 46 so as to disengage the locking member 45 from the engagement hole 47, the upper half member 31 of the armrest 30 can be pivoted into the horizontal posture (see FIG. 7).

In a use of the seat for a child 1 as a chair as shown in FIG. 1, the perpendicular posture of the upper half member 31 of the armrest 30 can be maintained by an engagement of the locking member 45 with the engagement hole 47, which is shown in FIG. 6. In a use of the seat for a child 1 as a bed on which one changes diapers of a child, the back portion 11 of the seat for a child 1 is reclined rearward, and the upper half member 31 of the armrest 30 is pivoted outward to the horizontal posture. Thus, one can change diapers of a child lying on the seat for a child 1, and use the upper surface 31*a* of the pivoted upper half member 31 of the armrest 30 as a board for an article.

In order to pivot the upper half member 31 of the armrest 30, the locking member 45 is at first disengaged from the engagement hole 47 through the opening button 46. Then, as shown by a chain line in FIGS. 8 and 11(*b*), the upper half member 31 of the armrest 30 is moved outward on the body member 32. Next, the upper half member 31 of the armrest 30 is rotated about the shaft 35, so that the upper half member 31 of the armrest 30 is pivoted into the horizontal posture as shown by two dot-chain lines in FIG. 8. In this state, the upper surface 31*a* of the pivoted upper half member 31 and the upper surface 32*a* of the body member 32 of the armrest 30 are flush with each other.

When a width of the armrest 30 is decreased toward a front thereof, the outside side surface of the body member 32 of the armrest 30 is not parallel with an inside side surface thereof. In this case, when the upper half part 31 of the armrest 30 is simply pivoted to the horizontal posture as described above, a gap might be formed between the outside side surface of the body member 32 of the armrest 30 and the inside side surface of the upper half member 31 of the armrest 30, the inside side surface of the upper half part 31 being opposed to the outside side surface of the body member 32 of the armrest 30. However, in the present invention, as described above, an orientation of the shaft 35 pivotally supporting the upper half member 31 of the armrest 30 can be varied within a predetermined angle. Thus, in accordance with a rotating movement of the upper half member 31 of the armrest 30 about the shaft 35, the rear end of the shaft 35 moves outward along the elongated fitting hole 43 of the bracket 41 as shown in FIG. 10, so that the shaft 35 is positioned in parallel with the outside side surface of the body member 32 of the armrest 30, which is shown by a chain line in FIG. 11(*c*). Accordingly, when the upper half member 31 of the armrest 30 is pivoted outward, the inside side surface 31*b* (the bottom surface when in the perpendicular posture) of the pivoted upper half member 31 of the armrest 30 comes into contact with the outside side surface 32*b* of the body member 32 of the armrest 30. At the same time, the upper surface 31*a* of the pivoted upper half member 31 of the armrest 30 and the upper surface 32*a* of the body member 32 of the armrest 30 are flush with each other, so that a board for an article is formed. As a result, a space around the armrest 30 can be effectively utilized.

What is claimed is:

1. A seat for a child comprising:

a seat portion on which a child can sit;

a back portion disposed on a rear part of the seat portion; and a pair of armrests disposed on right and left sides of the seat portion, wherein at least one of the armrests includes a body member, and an upper half member attached to the body member of the armrest through a hinge mechanism, the upper half member capable of being pivoted outside the body member, the upper half member of the armrest can be held at a perpendicular posture on the body member, and can move on the body member, and when the upper half member is slid on the body member and is pivoted outside the body member, an upper surface of the upper half member pivoted into a horizontal posture is flush with an upper surface of the body member, wherein the hinge mechanism includes a shaft disposed in the body member of the armrest to extend in the back and forth direction, and a link attached to the shaft to project outward from the body member of the armrest, the link being capable of rotating between a perpendicular position and a horizontal position, and wherein an end of the link is engaged with an elongated hole formed in a bottom surface of the upper half member, so that the upper half member of the armrest can be moved outside relative to the link.

2. The seat for a child according to claim 1, wherein the shaft of the body member is positioned inside the body member at an upper part on one side, and the link rotates between the perpendicular position and the horizontal position, with the end thereof constantly projecting outward from the body member.

3. The seat for a child according to claim 1, wherein the elongated hole formed in the bottom surface of the upper half member of the armrest extends in a right and left direction over substantially an entire width of the bottom surface.

4. The seat for a child according to claim 1, wherein the shaft is held, at a front part and a rear part thereof, by the body member of the armrest through brackets, each having a fitting hole with which the shaft is engaged, and the fitting hole of one of the brackets supporting the front part or the rear part of the shaft is an elongated hole extending in the right and left direction, so that an orientation of the shaft can be varied within a predetermined angle in the right and left direction.

5. The seat for a child according to claim 1, wherein the hinge mechanism includes at least two links disposed on the front part and the rear part of the shaft.

6. The seat for a child according to claim 1, wherein at least one of the upper surface of the body member of the armrest and the upper surface of the upper half member of the armrest pivoted into the horizontal posture is provided with a recess for an article.

7. The seat for a child according to claim 1, wherein a leg portion is disposed on a front part of the seat portion, and the leg portion is provided with, at right and left sides thereof, sidewalls.

8. The seat for a child according to claim 1, wherein the back portion has a reclining mechanism.

9. The seat for a child according to claim 1, wherein one of the upper half member and the body member is provided with a locking member which can be projected and retracted, and the other member is provided with an engagement hole with which the locking mechanism can be engaged, so as to maintain the upper half member of the armrest at the perpendicular posture on the body member.

* * * * *